US009728062B2

(12) United States Patent
Chang

(10) Patent No.: US 9,728,062 B2
(45) Date of Patent: Aug. 8, 2017

(54) WEARABLE DEVICE AND SYSTEM CAPABLE OF AUTOMATICALLY NOTIFYING PERSONAL EMERGENCY, AND METHOD THEREOF

(71) Applicant: HON HAI PRECISION INDUSTRY CO., LTD., New Taipei (TW)

(72) Inventor: Jen-Tsorng Chang, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 74 days.

(21) Appl. No.: 14/718,827

(22) Filed: May 21, 2015

(65) Prior Publication Data

US 2016/0071391 A1 Mar. 10, 2016

(30) Foreign Application Priority Data

Sep. 5, 2014 (CN) ..... 2014 1 0450704

(51) Int. Cl.
*G08B 21/04* (2006.01)
*G08B 25/01* (2006.01)

(52) U.S. Cl.
CPC ..... *G08B 21/0453* (2013.01); *G08B 25/016* (2013.01)

(58) Field of Classification Search
CPC ..... Y10T 24/2143; Y10T 24/2187; Y10T 24/2185; G08B 21/0202; G08B 25/016; G08B 21/0227; G08B 21/0263; G08B 21/0247; G08B 21/0294; H04B 1/385; H04B 1/3877; H04B 1/3833; H04B 1/38; H04M 1/6066; H04M 1/05; H04M 1/7253; H04M 1/72519; H04M 1/0254; H04W 88/04; H04W 88/02; G02C 11/10
See application file for complete search history.

(56) References Cited

U.S. PATENT DOCUMENTS 5,339,816 A * 8/1994 Akamatsu ..... A61B 5/028 600/455
2001/0037079 A1* 11/2001 Burbank ..... A61M 1/3451 604/6.09
2008/0001735 A1* 1/2008 Tran ..... G06F 19/3418 340/539.22
2008/0306383 A1* 12/2008 Kono ..... A61B 8/06 600/438
2013/0258814 A1* 10/2013 Rich ..... H04R 17/00 367/157
2014/0330087 A1* 11/2014 Succi ..... A61B 8/06 600/301
2015/0066000 A1* 3/2015 An ..... A61B 5/1455 606/1

(Continued)

*Primary Examiner* — An T Nguyen
(74) *Attorney, Agent, or Firm* — Steven Reiss

(57) ABSTRACT

A method for safeguarding the health of a user by automatically notifying a personal emergency is applied in a wearable device worn around a user's body or part. The method includes ultrasonic signals being periodically transmitted through the user's body and received by a receiver. A state of health of the user' body is determined according to the ultrasonic signals and a signal notifying a personal emergency is generated if the state of health of the user's body is abnormal. The signal is transmitted to at least one base station, to inform the base station to determine location of the wearable device for assistance-rendering purposes.

12 Claims, 8 Drawing Sheets

(56) References Cited

U.S. PATENT DOCUMENTS

| | | | | |
|---|---|---|---|---|
| 2015/0201948 | A1* | 7/2015 | Kornowski ..... | A61B 5/02042<br>606/203 |
| 2015/0238098 | A1* | 8/2015 | Park ..... | A61B 5/6844<br>600/473 |

* cited by examiner

WEARABLE DEVICE AND SYSTEM CAPABLE OF AUTOMATICALLY NOTIFYING PERSONAL EMERGENCY, AND METHOD THEREOF

FIELD

The subject matter herein generally relates to wearable devices, and particularly, to a wearable device capable of automatically notifying a personal emergency, a system including the wearable device, and a method thereof.

BACKGROUND

Senior citizens may suffer from health problems. Timely monitoring of the health data (such as a velocity of blood flow) of the senior citizens and taking emergency measures when an emergency situation happens is required.

BRIEF DESCRIPTION OF THE DRAWINGS

Implementations of the present technology will now be described, by way of example only, with reference to the attached figures.

DETAILED DESCRIPTION

Figure 1:
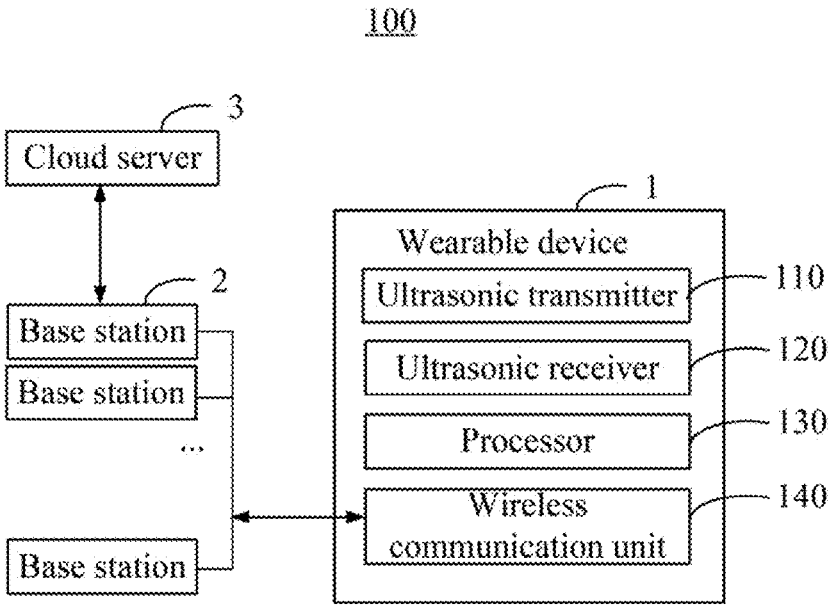
FIG. 1 is a block diagram of an embodiment of a system including a wearable device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

The term "comprising," when utilized, means "including, but not necessarily limited to"; it specifically indicates open-ended inclusion or membership in the so-described combination, group, series and the like.

FIG. 1 illustrates one embodiment of a system 100 capable of automatically notifying a personal emergency including a wearable device 1, a number of base stations 2, and a cloud server 3. Each base station 2 is within a wireless communication range of the wearable device 1, and can wirelessly communicate with the wearable device 1. The wearable device 1 is configured to generate a signal notifying a personal emergency when a user wearing the wearable device 1 is in an emergency situation, and transmit the signal to at least one of the base stations 2, to inform the base station 2 to issue an alarm to the cloud server 3. As such, remote friends, relatives, caregivers, or emergency care personnel using the cloud server 3 can immediately react to the emergency situation.

Figure 2:
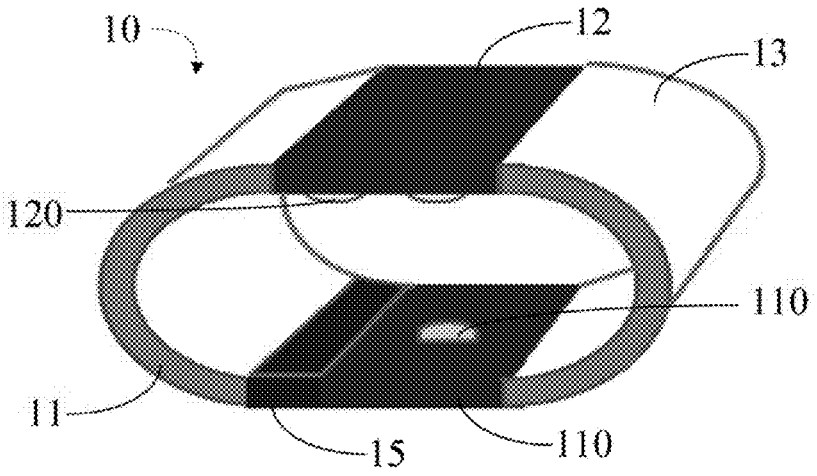
FIG. 2 is a perspective view of the wearable device of FIG. 1 when two ends of the wearable device are connected.
Figure 3:
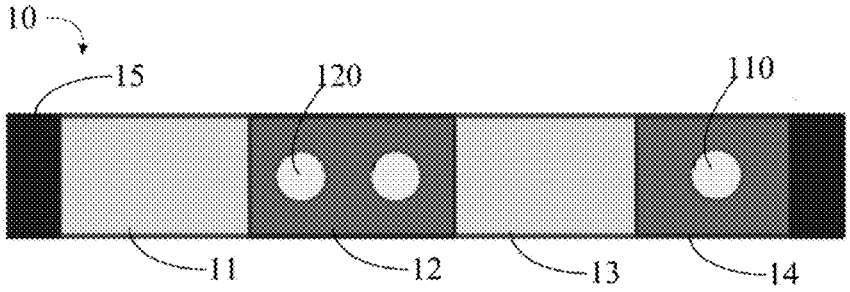
FIG. 3 is similar to FIG. 2, but showing the two ends of the wearable device being disconnected.

The wearable device 1 includes a main body 10 to be worn around the user's body. FIG. 2 illustrates that in at least one embodiment, the main body 10 is a wristband. FIG. 3 illustrates that the main body 10 includes two ends 15. The two ends 15 can be connected to each other, thereby allowing the main body 10 to be worn around the user's wrist. The main body 10 further includes a first portion 11, a second portion 12, a third portion 13, and a fourth portion 14 located between the two ends 15, and connected together in that order. The first end 11 and the third end 13 are made of elastic material such as rubber.

The wearable device 1 further includes at least one ultrasonic transmitter 110, at least one ultrasonic receiver 120, a processor 130 (shown in FIG. 1), and a wireless communication unit 140 (shown in FIG. 1) secured to the main body 10. The ultrasonic transmitter 110 and the ultrasonic receiver 120 are secured to internal surfaces of the second portion 12 and the fourth portion 14. When the two ends 15 are connected to each other, the ultrasonic transmitter 110 and the ultrasonic receiver 120 face each other. When in use, the user wears the wearable device 1 on his or her body, to cause the user's body or body part to be located between the ultrasonic transmitter 110 and the ultrasonic receiver 120. FIGS. 1-2 show only one ultrasonic transmitter 110 and two ultrasonic receivers 120. However, in other embodiments, the numbers of the ultrasonic transmitter 110 and the ultrasonic receiver 120 can be varied.

The ultrasonic transmitter 110 periodically transmits ultrasonic signals.

The ultrasonic receiver 120 receives the ultrasonic signals transmitted by the ultrasonic transmitter 110 through the user's body. In at least one embodiment, the ultrasonic transmitter 110 and the ultrasonic receiver 120 are made of polyvinylidene fluoride (PVDF).

The processor 130 receives the ultrasonic signals from the ultrasonic receiver 120, determines a state of health of the user's body according to the received ultrasonic signals, and determines whether the state of health of the user's body is normal or abnormal. If an abnormality is detected, the processor 130 generates a signal notifying a personal emergency. In at least one embodiment, the data concerning the state of health includes a velocity of blood flow in the user's body. Since the velocity of blood flow becomes slower when the user is in an emergency situation (for example, when the user falls in a faint or dies), an intensity of the ultrasonic signals passing through the user's body will decrease. Thus, the processor 130 can determine the velocity of blood flow according to the intensity of the received ultrasonic signals, and determines whether the state of health of the user's body is normal or abnormal according to the determined velocity of blood flow.

In at least one embodiment, the signal notifying a personal emergency includes a first signal and a second signal. The processor 130 determines whether the determined velocity of blood flow is less than a preset velocity. If the determined velocity of blood flow is less than the preset velocity, the processor 130 further determines whether a difference between the preset velocity and the determined velocity of blood flow is less than a preset amount. If the difference between the preset velocity and the determined velocity of blood flow is less than the preset amount, it indicates that the velocity of blood flow has decreased and the user may have fallen in a faint. Then, the processor 130 generates the first signal. Otherwise, the processor 130 may further determines whether the determined velocity of blood flow is nearly zero. If the determined velocity of blood flow is nearly zero, it indicates that the user may be dead. Then, the processor 130 generates the second signal.

The wireless communication unit 140 transmits the signal notifying a personal emergency to at least one of the base stations 2, to inform the base station 2 to determine location of the wearable device 1. In at least one embodiment, each base station 2 is a BLUETOOTH® station. The wireless communication unit 140 transmits the signal to the base station 2 via a BLUETOOTH® network. In at least one embodiment, when one base station 2 receives the signal from the wireless communication unit 140, the base station 2 determines the location of the wearable device 1 according to an intensity of the signal.

Figure 4:
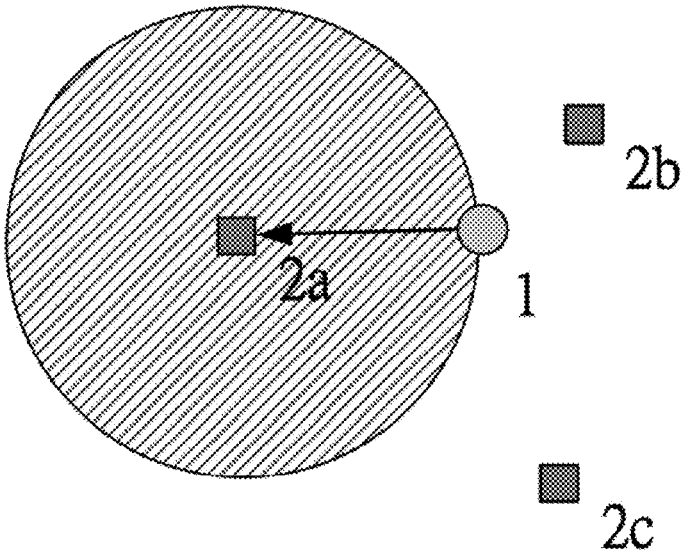
FIG. 4 is a diagrammatic view showing the wearable device of FIG. 1 transmitting a signal for a personal emergency to only one base station.
Figure 5:
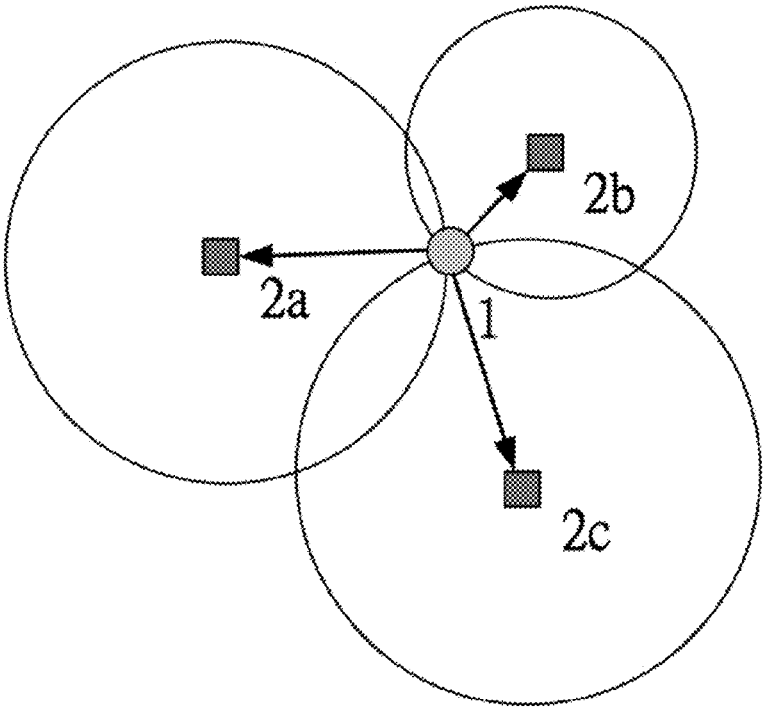
FIG. 5 is similar to FIG. 4, but showing the wearable device transmitting a signal for a personal emergency to three base stations.

FIG. 4 illustrates the wireless communication unit 140 transmitting the signal for notifying a personal emergency to only one base station 2 (base station 2*a* as shown). Since the wireless communication range of the base station 2 (BLUETOOTH® station) is usually less than 10 meters, the location of the wearable device 1 can be roughly determined by a circular area, wherein the center of the circular area is defined by the base station 2, and the radius of the circular area is inversely proportional to the intensity of the signal received by the base station 2. FIG. 5 illustrates the wireless communication unit 140 transmitting the signal to at least three base stations 2 (base stations 2*a*, 2*b*, and 2*c* as shown). Each of the at least three base stations 2 is at the center of a circle area which has a radius inversely proportional to the intensity of the signal received by the base station 2. In this case, the location of the wearable device 1 can be determined as being at the junction of at least three circular areas.

Then, the base station 2 generates an alarm according to the determined location, and transmits the alarm to the cloud server 3. In at least one embodiment, only one base station 2 is capable of wirelessly communicating with the cloud server 3 (hereinafter "base server-station 2", and the other base stations 2 are referred to as "base non-server-stations 2"). Any base non-server-station 2 which is remote from the base server-station 2 can wirelessly communicate with the base non-server-station 2 which is adjacent to the base server-station 2, and the base non-server-station 2 which is adjacent to the base server-station 2 can wirelessly communicate with the cloud server 3. Thus, when the base server-station 2 receives the signal from the wearable device 1, the base server-station 2 directly transmits the alarm to the cloud server 3. When one base non-server-station 2 receives the signal from the wearable device 1, the base non-server-station 2 indirectly transmits the alarm to the cloud server 3 via the base server-station 2.

Figure 6:
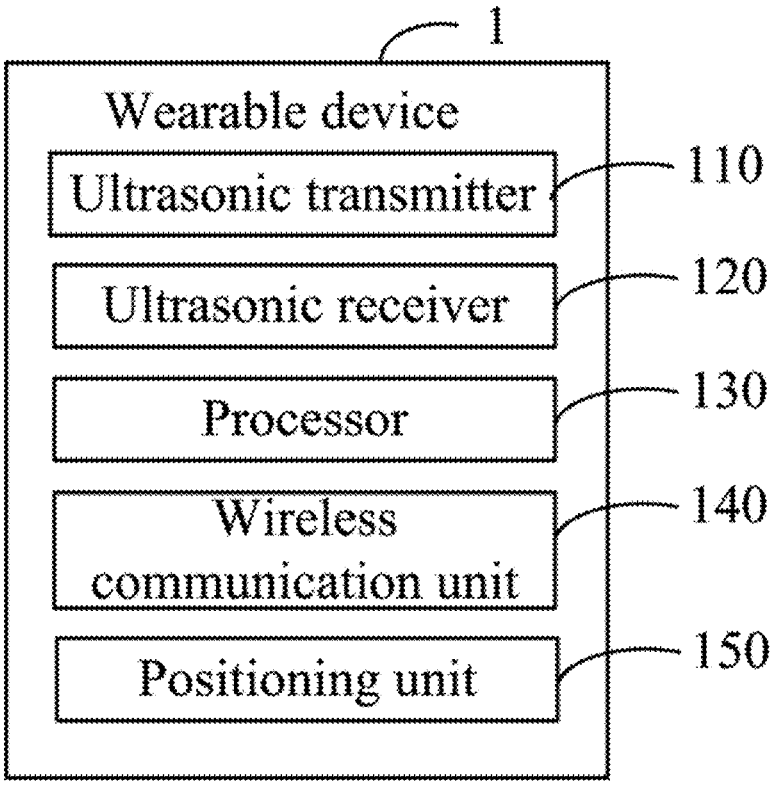
FIG. 6 is a block diagram of another embodiment of a wearable device.

FIG. 6 illustrates that in another embodiment, the wearable device 1 further includes a positioning unit 150. When the state of health of the user's body is abnormal, the positioning unit 150 detects the location of the wearable device 1, and the processor 130 generates a signal notifying a personal emergency including the location so detected. The wireless communication unit 140 transmits the signal including the detected location of the wearable device 1 to one base station 2. As such, the base station 2 can determine the detected location of the wearable device 1 included in the signal, generate an alarm according to the determined location, and transmit the alarm to the cloud server 3. The positioning unit 150 can be a global positioning system (GPS) device or an assisted global positioning system (AGPS) device. The location can be a geographical location or a place name corresponding to the geographical location.

Figure 7:
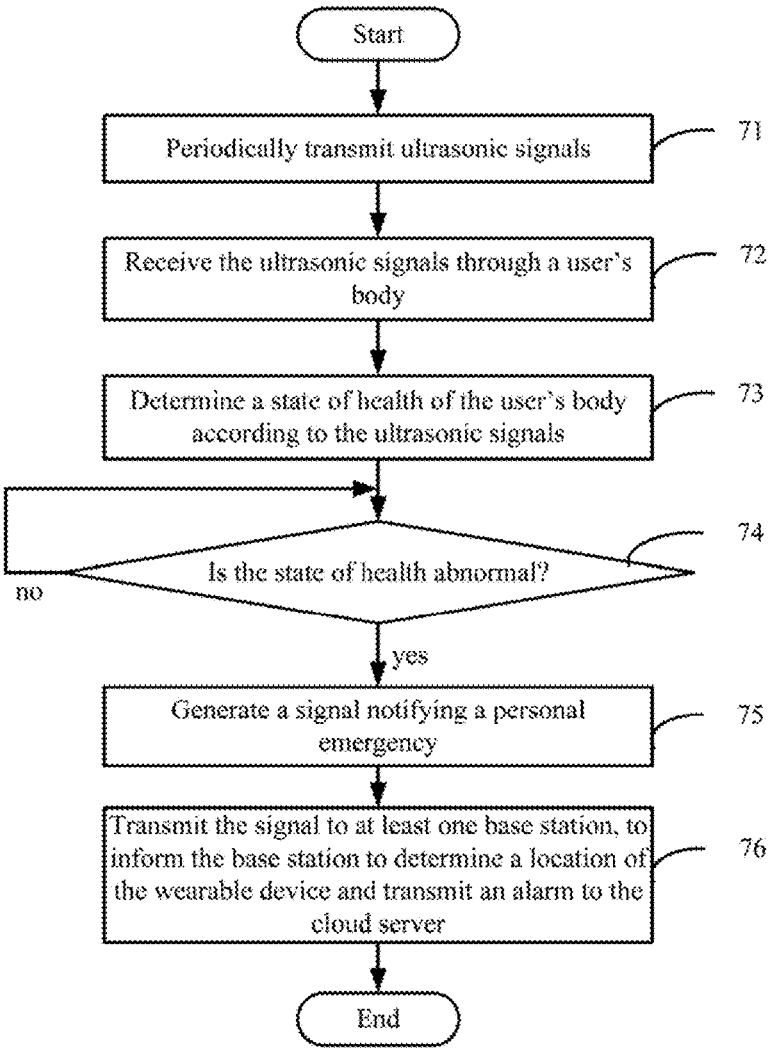
FIG. 7 is a flowchart of an embodiment of a method for automatically notifying a personal emergency.

Referring to FIG. 7, a flowchart of a method for automatically notifying a personal emergency is presented in accordance with an example embodiment. The example method is provided by way of example, as there are a variety of ways to carry out the method. The method described below can be carried out using the configurations illustrated in FIGS. 1-5, for example, and various elements of these figures are referenced in explaining the example method. Each block shown in FIG. 7 represents one or more processes, methods or subroutines, carried out in the exemplary method. Additionally, the illustrated order of blocks is by example only and the order of the blocks can change. The exemplary method can begin at block 71.

At block 71, an ultrasonic transmitter periodically transmits ultrasonic signals.

At block 72, an ultrasonic receiver receives the ultrasonic signals transmitted by the ultrasonic transmitter through the user's body.

At block 73, a processor receives the ultrasonic signals from the ultrasonic receiver, and determines a state of health of the user's body according to the received ultrasonic signals.

At block 74, the processor determines whether the state of health of the user's body is normal or abnormal. If abnormal, the procedure goes to block 75; otherwise block 73 is repeated.

At block 75, the processor generates a signal notifying a personal emergency.

At block 76, a wireless communication unit transmits the signal to at least one of the base stations, to inform the base station to determine the location of the wearable device according to the intensity of the signal, to generate an alarm according to the determined location, and transmit the alarm to the cloud server.

Figure 8:
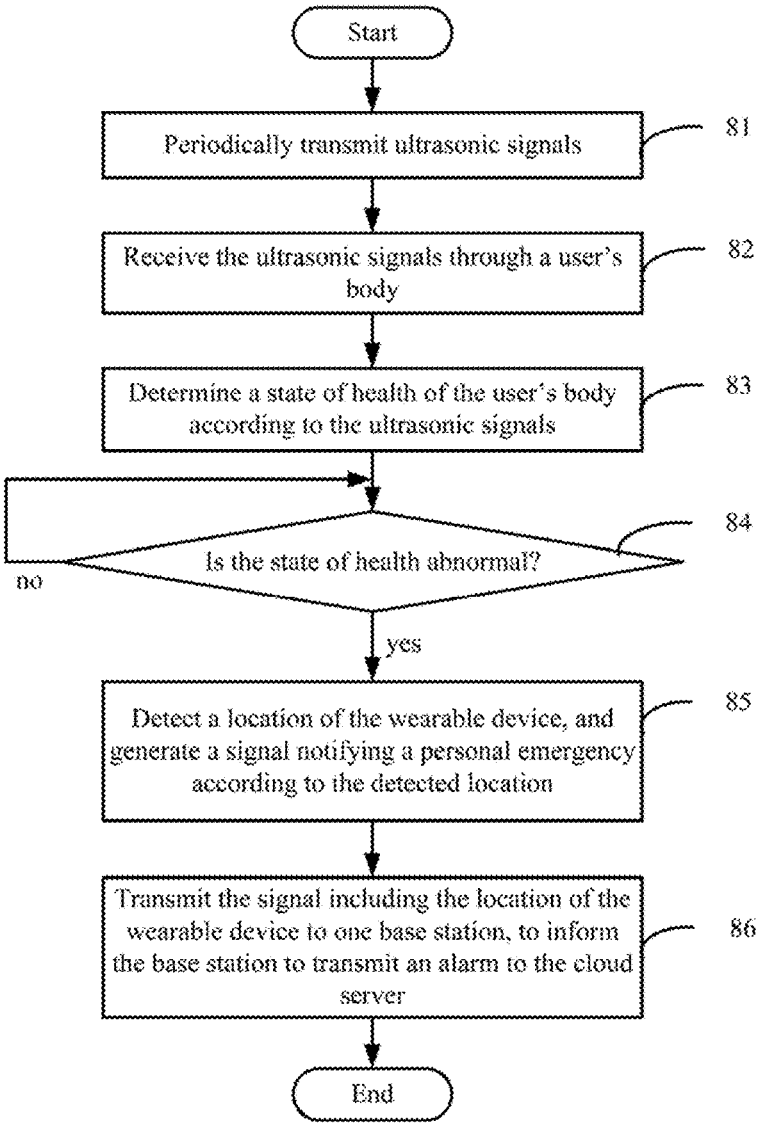
FIG. 8 is a flowchart of another embodiment of a method for automatically notifying a personal emergency.

Referring to FIG. 8, a flowchart of a method for automatically notifying a personal emergency is presented in accordance with another embodiment. The example method is provided by way of example, as there are a variety of ways to carry out the method. The method described below can be carried out using the configurations illustrated in FIG. 6, for example, and various elements of these figures are referenced in explaining the example method. Each block shown in FIG. 8 represents one or more processes, methods, or subroutines, carried out in the exemplary method. Additionally, the illustrated order of blocks is by example only and the order of the blocks can change. The exemplary method can begin at block 81.

At block 81, an ultrasonic transmitter periodically transmits ultrasonic signals.

At block 82, an ultrasonic receiver receives the ultrasonic signals transmitted by the ultrasonic transmitter through the user's body.

At block 83, a processor receives the ultrasonic signals from the ultrasonic receiver, and determines a state of health of the user's body according to the received ultrasonic signals.

At block 84, the processor determines whether the state of health of the user's body is normal or abnormal. If abnormal, the procedure goes to block 85; otherwise block 83 is repeated.

At block 85, a positioning unit detects the location of the wearable device, and the processor generates a signal for a personal emergency including the detected location.

At block 86, a wireless communication unit transmits the signal including the detected location of the wearable device to one base station, to inform the base station to determine the detected location of the wearable device included in the signal, to generate an alarm according to the determined location, and transmit the alarm to the cloud server.

It is to be understood, even though information and advantages of the present embodiments have been set forth in the foregoing description, together with details of the structures and functions of the present embodiments, the disclosure is illustrative only; changes may be made in detail, especially in matters of shape, size, and arrangement of parts within the principles of the present embodiments to the full extent indicated by the plain meaning of the terms in which the appended claims are expressed.

What is claimed is:

1. A wearable device for automatically notifying personal emergency comprising:

a main body configured to be worn around a user's body;

an ultrasonic transmitter secured to the main body, and configured to periodically transmit ultrasonic signals;

an ultrasonic receiver secured to the main body, and configured to receive the ultrasonic signals transmitted by the ultrasonic transmitter through the user's body;

a processor secured to the main body, and configured to receive the ultrasonic signals from the ultrasonic receiver, determine a state of health of the user's body according to the received ultrasonic signals, determine whether the state of health of the user's body is abnormal, and generate a signal for notifying emergency personal in event the state of health of the user's body is abnormal; and a wireless communication unit secured to the main body, and configured to transmit the signal to at least one base station, to inform the at least one base station to determine a location of the wearable device, wherein data concerning the state of health comprises a velocity of blood flow in the user's body; the processor is configured to determine the velocity of blood flow according to an intensity of the received ultrasonic signals, and determine whether the state of health of the user's body is abnormal according to the determined velocity of blood flow; wherein the signal notifying a personal emergency comprises a first signal and a second signal; the processor is configured to generate the first signal when the determined velocity of blood flow is less than a preset velocity and a difference between the preset velocity and the determined velocity of blood flow is less than a preset amount, and is further configured to generate the second signal when the determined velocity of blood flow is nearly zero.

2. The wearable device of claim 1, wherein each base station is a BLUETOOTH® station; the wireless communication unit is configured to transmit the signal to the base station via a BLUETOOTH® network.

3. The wearable device of claim 1, further comprising a positioning unit, wherein the positioning unit is configured to detect the location of the wearable device when the state of health of the user's body is abnormal; the processor is configured to generate a signal for a personal emergency including the detected location when the state of health of the user's body is abnormal; the wireless communication unit is configured to transmit the signal including the location of the wearable device to one base station, thereby allowing the base station to determine the location of the wearable device included in the signal.

4. The wearable device of claim 3, wherein the positioning unit is a global positioning system device or an assisted global positioning system device.

5. The wearable device of claim 1, wherein the main body comprises two ends able to be connected to each other.

6. The wearable device of claim 5, wherein the main body further comprises a first portion, a second portion, a third portion, and a fourth portion located between the two ends, and connected together in that order; the ultrasonic transmitter and the ultrasonic receiver are secured to internal surfaces of the second portion and the fourth portion, and face each other when the two ends are connected to each other.

7. The wearable device of claim 1, wherein the ultrasonic transmitter and the ultrasonic receiver are made of polyvinylidene fluoride.

8. A system for automatically notifying personal emergency comprising:

a wearable device comprising:

a main body configured to be worn around a user's body;

an ultrasonic transmitter secured to the main body, and configured to periodically transmit ultrasonic signals;

an ultrasonic receiver secured to the main body, and configured to receive the ultrasonic signals transmitted by the ultrasonic transmitter through the user's body;

a processor secured to the main body, and configured to receive the ultrasonic signals from the ultrasonic receiver, determine a state of health of the user's body according to the received ultrasonic signals, determine whether the state of health of the user's body is abnormal, and generate a signal for notifying emergency personal in event the state of health of the user's body is abnormal; and a wireless communication unit secured to the main body; and a plurality of base stations capable of wirelessly communicating with the wearable device, the wireless communication unit configured to transmit the signal to at least one of the base stations, the at least one base station configured to determine a location of the wearable device, and generate an alarm according to the determined location; and a cloud server, the at least one base station further configured to transmit the alarm to the cloud server;

wherein data concerning the state of health comprises a velocity of blood flow in the user's body; the processor is configured to determine the velocity of blood flow according to an intensity of the received ultrasonic signals, and determine whether the state of health of the user's body is abnormal according to the determined velocity of blood flow; wherein the signal notifying a personal emergency comprises a first signal and a second signal; the processor is configured to generate the first signal when the determined velocity of blood flow is less than a preset velocity and a difference between the preset velocity and the determined velocity of blood flow is less than a preset amount, and is further configured to generate the second signal when the determined velocity of blood flow is nearly zero.

9. The system of claim 8, wherein the at least one base station is configured to determine the location of the wearable device according to an intensity of the signal.

10. The system of claim 8, wherein the signal comprises the location of the wearable device; and the at least one base station is configured to determine the location of the wearable device included in the signal.

11. A method for automatically notifying personal emergency applied in a wearable device worn around a user's body, the method comprising:

periodically transmitting ultrasonic signals;

receiving the ultrasonic signals transmitted through the user's body;

determining a velocity of blood flow in the user's body concerning state of health of the user's body according to an intensity of the received ultrasonic signals;

determining whether the state of health of the user's body is abnormal according to the determined velocity of blood flow;

generating a first signal for notifying emergency personal, in event the state of health of the user's body is abnormal, the determined velocity of blood flow is less than a preset velocity, and a difference between the preset velocity and the determined velocity of blood flow is less than a preset amount;

generating a second signal for notifying emergency personal, in event the state of health of the user's body is abnormal and the determined velocity of blood flow is nearly zero; and transmitting the first signal or the second signal to at least one base station, to inform the at least one base station to determine location of the wearable device according to an intensity of the signal.

12. A method for automatically notifying personal emergency applied in a wearable device worn around a user's body, the method comprising:

periodically transmitting ultrasonic signals;

receiving the ultrasonic signals transmitted through the user's body;

determining a velocity of blood flow in the user's body concerning state of health of the user's body according to an intensity of the received ultrasonic signals;

determining whether the state of health of the user's body is abnormal according to the determined velocity of blood flow;

detecting a location of the wearable device; generating a first signal for notifying emergency personal including the detected location, in event the state of health of the user's body is abnormal, the determined velocity of blood flow is less than a preset velocity, and a difference between the preset velocity and the determined velocity of blood flow is less than a preset amount generating a second signal for notifying emergency personal including the detected location, in event the state of health of the user's body is abnormal and the determined velocity of blood flow is nearly zero; and transmitting the first signal or the second signal including the detected location to at least one base station, to inform the at least one base station to determine the detected location of the wearable device included in the signal.

* * * * *